United States Patent [19]

Levene et al.

[11] Patent Number: 4,960,019

[45] **Date of Patent: * Oct. 2, 1990**

[54] VACUUM DIE CUTTING METHOD AND APPARATUS

[75] Inventors: Martin M. Levene; William W. Lessard, both of Kitchener, Canada

[73] Assignee: Ontario Die Company, Ltd., Ontario, Canada

[ * ] Notice: The portion of the term of this patent subsequent to Aug. 1, 2006 has been disclaimed.

[21] Appl. No.: 222,031

[22] Filed: Jul. 21, 1988

Related U.S. Application Data

[63] Continuation-in-part of Ser. No. 107,747, Oct. 13, 1987, Pat. No. 4,852,439.

[51] Int. Cl.[5] ..... B26D 7/02

[52] U.S. Cl. ..... 83/19; 83/29; 83/139; 83/176; 83/451; 269/21

[58] Field of Search ..... 83/19, 29, 139, 176, 83/451; 269/21

[56] References Cited

U.S. PATENT DOCUMENTS 4,672,870 6/1987 Levene et al. ..... 83/19
4,852,439 8/1989 Levene et al. ..... 83/19

FOREIGN PATENT DOCUMENTS 2164889 12/1987 United Kingdom .

*Primary Examiner*—Hien H. Phan
*Attorney, Agent, or Firm*—Krass & Young

[57] ABSTRACT

A stationary steel rule cutting die for cutting a fixed pattern in each of a plurality of stacked compressible material layers according to the shape of the steel rule die and including a vacuum system for reducing the stacked height of the compressible material layers prior to cutting. The die assembly includes an enclosure comprising an upper wall and collapsible side walls extending downwardly from the upper wall. A rigid annular structure is secured to the lower edge of the collapsible side walls. The enclosure is positioned over the stacked compressible material layers with an annular sealing surface defined on the lower peripheral edges of the rigid annular structure coacting with an upwardly facing, closed loop sealing surface defined on the steel rule cutting die to define a sealed chamber from which air is exhausted through the rigid annular structure to collapse the side walls of the enclosure and compress the material layers prior to cutting.

26 Claims, 5 Drawing Sheets

FIG - 14
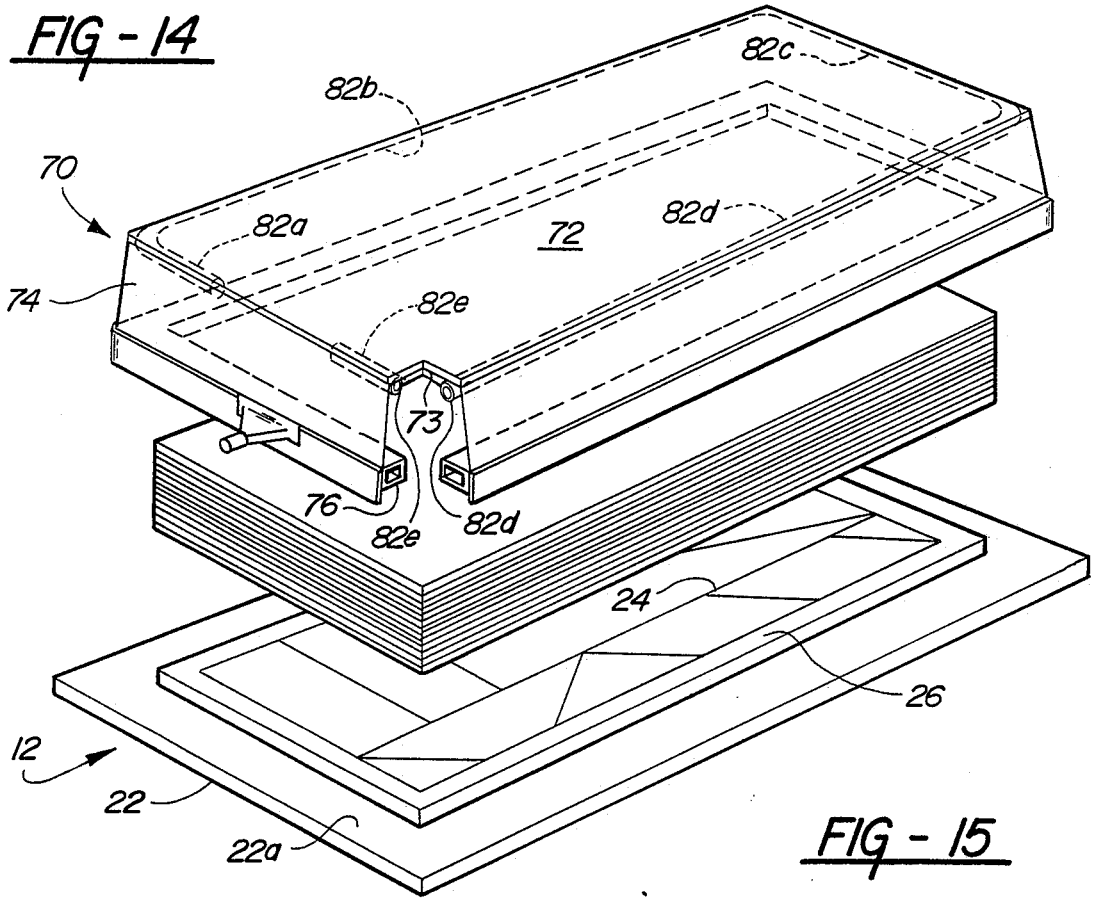
FIG - 15
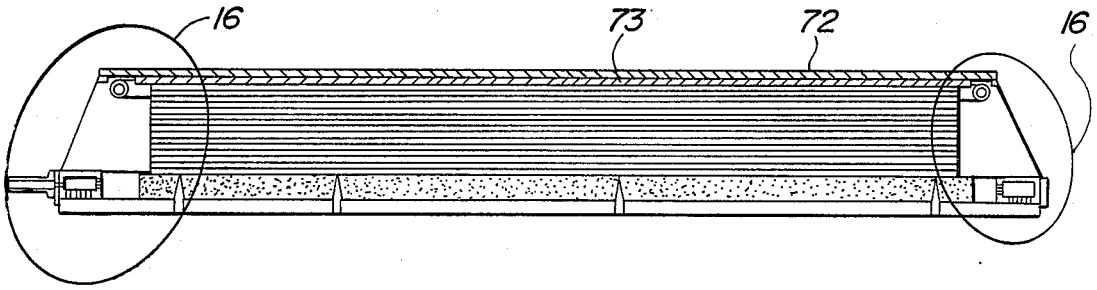
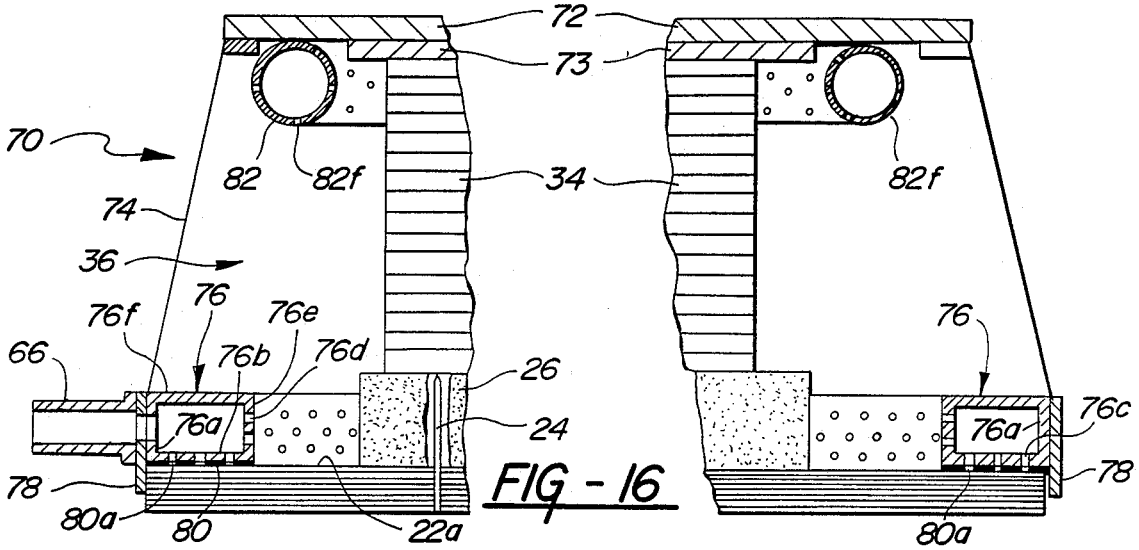
FIG - 16

VACUUM DIE CUTTING METHOD AND APPARATUS

REFERENCE TO RELATED APPLICATION

This application is a continuation-in-part of U.S. patent application Ser. No. 107,747 filed on Oct. 13, 1987, now U.S. Pat. No. 4,852,439.

BACKGROUND OF THE INVENTION

This invention relates to steel rule die cutting and particularly to a method and apparatus for cutting single and stacked layers of compressible materials such as foam plastic by means of a stationary steel rule die.

Steel rule dies are commonly used for cutting cloth and clothlike materials such as natural textiles, and synthetic materials such as vinyl. Steel rule dies are particularly advantageous in the repetitive cutting of specific shapes such as shirt collars, automobile interior panels and the like. In brief, a steel rule die typically comprises a base or backing board in which a groove matching the pattern to be cut is formed, and a length of steel rule embedded in the board with a sharpened exposed edge extending upwardly tberefrom. The die is used in combination with a cutting table and a press which may either be single-cut or progressive feed.

A problem arises when it is necessary or desirable to cut relatively thick but compressible materials such as foam-backed vinyl, foam rubber, and plastic foam. A stack or a particularly thick single layer of such material is sufficiently unstable that an accurate cut is often not possible using- conventional techniques.

One approach to the more accurate cutting of foam materials is disclosed in U.S. Pat. Nos. 3,790,154, 3,765,289 and 3,815,221, all assigned to Gerber Garment Technology, Inc. of East Hartford, Conn. These patents, and other related patents assigned to Gerber, disclose a vacuum table which is used primarily to hold sheet material in place while it is cut by a two-axis single blade jigsaw type cutter. According to these patents, a sheet of Mylar or other air impervious material can placed over a stack of compressible materials such that the vacuum table creates a vacuum under the sheet to pull downwardly on the sheet and maintain the entire stack in a stable, compressed condition during the cutting process. In a further Gerber U.S. Pat. No. 4,060,016, the jigsaw type cutter is replaced by a rotatable turret carrying a plurality of blanking dies which are selectively rotated into position and driven downwardly through an air impervious sheet and through the stacked materials to form a stack of cut patterns corresponding to the shape of the particular die selected.

In all of these patented systems the board on which the stacked material is located must be capable of receiving the penetrations of the reciprocating knife as well as maintaining a vacuum for the principal purpose of holding the stack in place and for the secondary purpose of evacuating the volume under the air impervious sheet.

All of these patented arrangements also suffer from the disadvantage that the air impervious sheet is cut in the process of cutting the stacked material layers with consequent loss of vacuum and thereby a loss of stability of the stack. And whereas certain of the Gerber patents describe means for "healing" the cut in the air impervious sheet behind the cutting member, these healing arrangements unduly complicate the overall cutting apparatus and/or are not totally successful in preventing loss of vacuum with a consequent loss of stability of the stack.

It has been proposed to use steel rule blanking or cutting dies with air evacuation compression so as to facilitate and improve the use of such dies to cut compressible materials. These proposals have involved the use of an air impervious cover or shroud positioned over a stack of compressible material positioned on the steel rule upper edge to define a vacuum chamber, and means for evacuating the vacuum chamber to compress and reduce the thickness of a stack of layers before cutting the layers with the rule. Such an arrangement is shown in U.S. Pat. No. 4,543,862 assigned to the assignee of the present application. Whereas the method and apparatus disclosed in U.S. Pat. No. 4,543,862 is generally satisfactory for the cutting of compressible materials and has achieved significant commercial acceptance, the procedure of this patented process, whereby a large shroud of air impervious material is positioned over the stack of compressible material to form the vacuum chamber, is labor intensive and therefore contributes significantly to the overall cost of the process. Further, the shroud tends to wear with repeated usage and must eventually be replaced with the result that the materials cost of the process is thereby increased.

SUMMARY OF THE INVENTION

This invention is directed toward the provision of an improved steel rule die assembly utilizing air evacuation techniques.

More specifically, the present invention is directed to the provision of a steel rule die employing air evacuation techniques in which the labor and material costs of the process are minimized.

More specifically, the present invention is directed to the provision of a steel rule die, air evacuation process of the type disclosed in U.S. Pat. No. 4,543,862 in which the shroud of the patented process is eliminated with consequent labor and material savings.

According to the invention method, a generally planar support structure is provided; an upwardly facing cutting edge is provided on the support structure; a layer of compressible material is positioned over the cutting edge; an enclosure is formed over the layer of material and over the cutting edge with the enclosure including a top wall overlying the layer of material and collapsible side walls extending between the top wall and the support structure in circumferentially surrounding relation to the cutting edge and to the layer of material to define a sealed vertically collapsible chamber totally enclosing the cutting edge and the layer of material; air is evacuated from the sealed chamber to vertically collapse the side walls of the enclosure to an extent to vertically compress the layer of material and substantially reduce its vertical thickness and to press the compressed reduced thickness layer of material downwardly against the cutting edge; and the cutting edge is moved through the compressed reduced thickness layer of material by a cutting press to cut a fixed pattern in the material corresponding to the shape of the cutting edge. This arrangement retains all of the inherent advantages of the process of U.S. Pat. No. 4,453,862 while eliminating the shroud of that process and thereby eliminating the labor and material expenses associated with the shroud.

According to a further feature of the invention method, a closed loop peripheral upwardly facing sealing area is defined on the support structure around the cutting edge; the enclosure side walls are permanently secured to and extend downwardly from the enclosure top wall to form a unitary enclosure; and the sealed chamber is formed by positioning the unitary enclosure over the layer of material with an annular sealing surface defined adjacent the lower edges of the enclosure side walls sealingly engaging the closed loop sealing surface on the support structure. This arrangement allows the unitary enclosure to be readily positioned over the stacked layers of material by a single operator and allows the unitary enclosure to be used for repeated cutting operations without derogation of the enclosure.

In one embodiment of the invention method, the side walls of the enclosure are formed of a coated open cell material which collapses in response to evacuation of air from the chamber. This open cell construction provides an efficient and inexpensive means of providing the invention enclosure.

According to a further feature of this embodiment of the invention method, the outer surfaces of the side walls of the enclosure are coated with an air impervious material. This arrangement precludes inward movement of air through the side walls and into the vacuum chamber so as to maximize the effectiveness of the evacuation process.

In another embodiment of the invention method, the enclosure side walls comprise an annular curtain of flexible sheet material which collapses in response to evacuation of air from the chamber. This arrangement provides a further efficient and inexpensive means of providing the invention enclosure.

According to a further feature of this embodiment of the invention method, an annular rigid frame is secured to the lower edge of the curtain and sealingly engages with the closed loop sealing surface defined on the support structure around the cutting edge. The rigid frame coacts with the top wall to provide definition for the enclosure and provides a means of sealingly engaging the upwardly facing closed loop sealing surface on the support structure. The annular frame preferably incudes a downwardly extending annular flange arranged to snuggle around the support structure defining the closed loop sealing surface to positively position the enclosure relative to the support structure.

According to a further feature of this embodiment of the invention method, an annular layer of resilient material is secured to the annular underface of the rigid frame. This arrangement facilitates the sealing engagement of the frame with the closed loop sealing surface to ensure the integrity of the vacuum chamber.

The invention apparatus comprises a generally planar support structure; a cutting edge extending upwardly from the support structure and adapted to have the compressible material positioned thereon; enclosure means including a top wall overlying the compressible material to be cut and collapsible side walls extending between the top wall and the support structure in circumferentially surrounding relation to the cutting edge and to the overlying material to be cut and coacting with the support structure and the top wall to form a sealed, vertically collapsible chamber totally enclosing the cutting edge and the material to be cut; and means for evacuating air from the chamber to collapse the side walls and collapse the chamber to an extent to vertically compress the material and press the compressed material downwardly against the cutting edge. This arrangement provides an efficient and extremely cost effective apparatus for cutting the layers of compressible material on a suitable cutting press.

According to a further feature of the invention apparatus, the support structure defines a closed loop upwardly facing sealing surface in circumferentially surrounding relation to the cutting edge, the side walls of the enclosure means are secured to and extend downwardly from the top wall of the enclosure means, and an annular sealing surface is defined at the lower edges of the side walls for releasable sealing engagement with the closed loop sealing surface to define the sealed chamber.

According to a further feature of the invention apparatus, the apparatus further includes a closed loop tubular member positioned within the chamber with the lower peripheral edges of the side walls of the enclosure means sealingly engaging the closed loop sealing surface; the walls of the tubular member within the chamber are perforated; and the evacuating means comprises means for drawing air out of the tubular member and thereby out of the chamber.

In one embodiment of the invention apparatus, the tubular member is positioned on the support surface in surrounding relation to the cutting edge and the closed loop upwardly facing sealing surface is defined on the upper face of the closed loop tubular member.

In another embodiment of the invention apparatus, the tubular member is positioned beneath and around the periphery of the top wall within the side walls.

In another embodiment of the invention apparatus, the tubular member is secured to the lower edges of the side walls and the lower face of the tubular member defines the annular sealing surface for sealing coaction with the closed loop sealing surface defined on the support structure.

According to a feature of one embodiment of the invention apparatus, the side walls of the enclosure means are formed of an open cell material which collapses in response to evacuation of air from the chamber. According to a further feature of this embodiment, the outer surfaces of the open cell side walls are coated with an air impervious material to preclude movement of air through the side walls into the chamber.

According to a feature of another embodiment of the invention apparatus, the enclosure side walls comprise an annular curtain of flexible sheet material which collapses in response to evacuation of the chamber.

According to a further feature of this embodiment of the invention apparatus, an annular rigid frame, preferably having an angled cross-sectional configuration, is secured to the lower edge of the curtain and sealingly engages with the closed loop sealing surface.

According to a further feature of this embodiment of the invention apparatus, an annular layer of resilient material is secured to the annular underface of the rigid frame to facilitate the sealing engagement of the frame with the closed loop sealing surface.

BRIEF DESCRIPTION OF THE DRAWINGS

FIG. 14 is an exploded perspective view of a still further modified form of the invention die cutting apparatus;

FIG. 15 is a longitudinal cross sectional view of the die cutting apparatus of FIG. 14 showing the material and its condition prior to compression; and FIG. 16 is a detailed view within the circle 16 of FIG. 15.

DETAILED DESCRIPTION OF THE PREFERRED EMBODIMENTS

Figure 1:
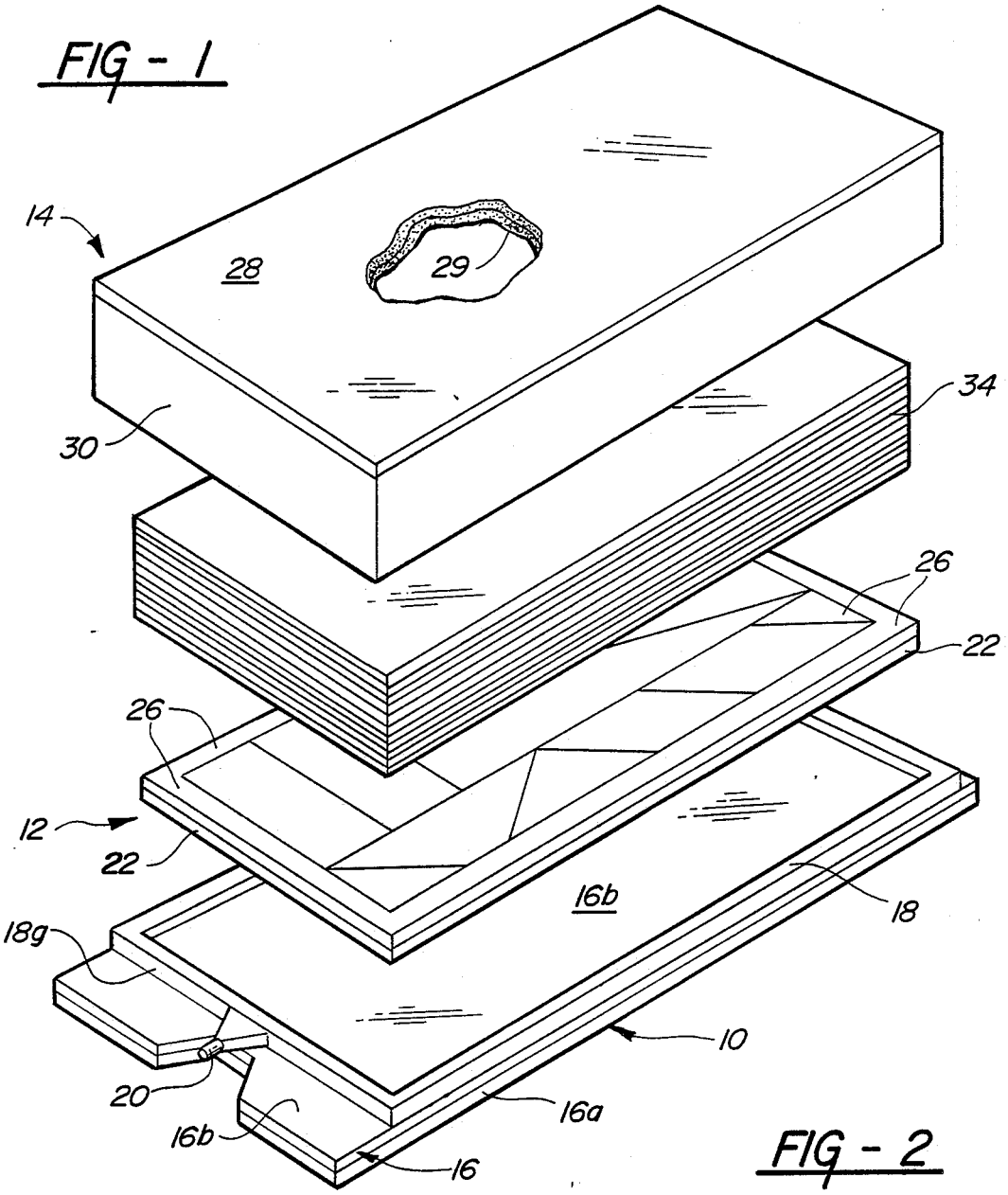
FIG. 1 is an exploded perspective view of a steel rule die cutting apparatus according to the invention.

Referring to the drawings, and particularly to FIGS. 1–4, the invention apparatus, broadly considered, includes a support structure or carrier 10, a steel rule die assembly 12, and an enclosure 14.

Support structure 10 includes a base plate 16 of elongated generally rectangular configuration and a tubular fence or frame 18.

Base plate 16 is laminar and may be formed, for example, of a lower ⅜ inch thick polypropylene plate 16*a* suitably bonded to an upper ⅛ inch thick steel plate 16*b*.

Tubular fence or frame 18 is of generally rectangular configuration and extends around the perimeter of base plate 16. Tubular fence 18 is preferably formed of a metallic material and is generally rectangular in transverse cross section. The lower and outer peripheral walls 18*b* and 18*c* of tubular fence 18 are imperforate and the upper and inner walls 18*a* and 18*d* are provided with perforations 18*e*. A tubular spout 20 communicates with an opening 18*f* in the outer wall 18*c* of the tubular fence so as to provide communication between the interior of the spout and the interior of the tubular member.

Steel rule die assembly 12 includes a die board 22, a steel rule 24 and foam members 26.

Die board 22 may be formed of ⅝ inch thick beechwood, birch, maple, or suitable plywood and has a generally rectangular configuration sized to fit loosely within the inner perimeter of tubular fence 18.

Steel rule 24 extends upwardly from die board 22 and has an overall configuration corresponding to the desired shape to which the compressible material is to be cut. Steel rule 24 is driven at its lower edge portions into slots 22*a* provided in die board 22 and presents a sharpened upper exposed edge 24*a*.

Foam members 26 have an open cell construction and are configured to fill the areas defined between the various sections of the steel rule die 24 as well as the areas between the outer peripheral surfaces of the steel rule die and the peripheral edges of die board 22. Foam members 26 are of a thickness generally corresponding to the height to which the steel rule die portions 24 extend above the upper surface of die board 22 so that the upper surfaces of foam members 26 are substantially flush with the cutting edges of the steel rule die sections.

Enclosure 14 includes a top wall member 28, a disposable cutting pad 29, and side wall members 30.

Top wall member 28 is formed of a suitable rigid plastic material, such as a nylon or a polypropylene material, and has a rectangular configuration generally conforming to the configuration of base plate 16.

Disposable cutting pad 29 is formed of a material that is penetrable by the steel rule die and is suitably removably secured to the underface of top wall member 28 by the use of double sticky tape or by the use of screws. Pad 29 protects top member 28 from the cutting action of the steel rule die and may, for example, be formed of the same nylon or polypropylene material as top wall member 28. The use of a separate pad secured to the underface of the top wall member allows the pad to be periodically replaced without need to replace the top wall member.

Side wall members 30 are formed of a soft open cell material and are coated on their outside surfaces 30*a* and on their lower peripheral edges 30*b* with an air impervious flexible coating 32 such, for example, as a suitable urethane coating. The upper peripheral edge portions of side wall members 30 are suitably secured, as by gluing, to the peripheral under surfaces of top wall 28 and extend downwardly from top wall 28 to form a unitary enclosure therewith. Side wall members 30 have a height generally corresponding to the height of the stack of material layers to be cut. The lower peripheral edges 30*b* of side wall members 30 form a closed loop downwardly facing sealing surface 30*c* having a size and configuration generally conforming to an upwardly facing closed loop sealing surface 18*g* defined by the upper surface of upper wall portion 18*a* of tubular fence 18. Pad 29 has a generally rectangular configuration and fits within the side wall members 30.

Figure 2:
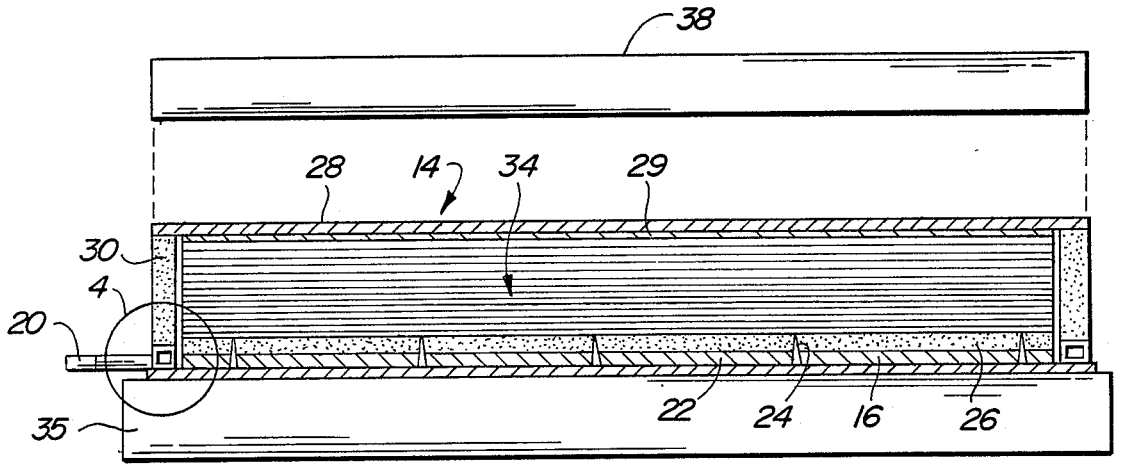
FIG. 2 is a longitudinal cross-sectional view of the invention steel rule die cutting apparatus showing the condition of the material to be cut before compression.
Figure 3:
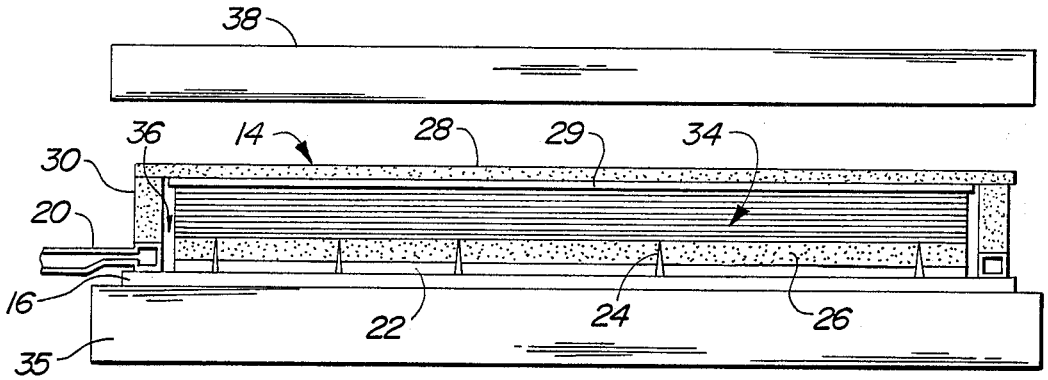
FIG. 3 is a longitudinal cross-sectional view showing the materials after compression.
Figure 4:
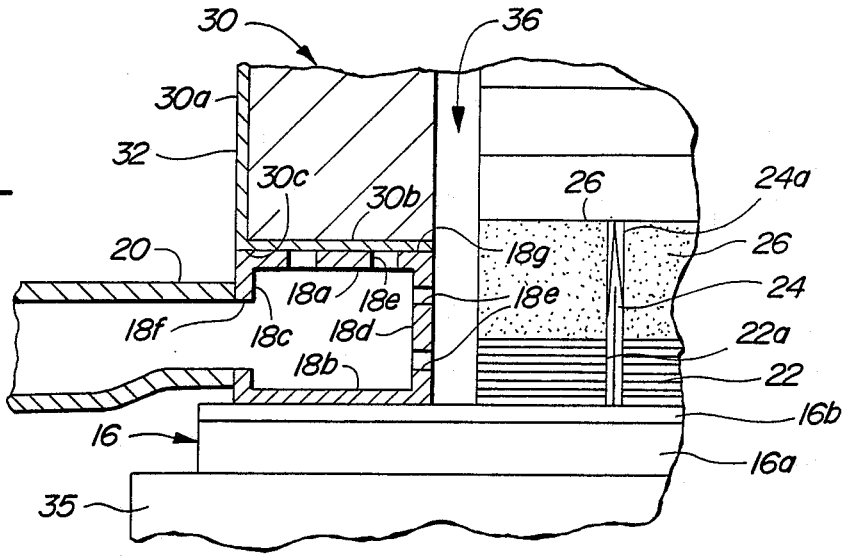
FIG. 4 is a detailed view within the circle 4 of FIG. 2.

In the use of the embodiment of FIGS. 1–4, support structure 10 is positioned on the base or lower platen 35 of a suitable cutting press; steel die assembly 12 is positioned on base plate 16 within tubular fence 18; a plurality of layers 34 of compressible foam materials or other high pile or spongy fabrics having a size and configuration generally corresponding to the size and configuration of the steel rule die assembly are positioned on top of the steel rule die assembly with the lower surface of the stack resting on the upper surface of the foam members 26 in contiguous relation to the sharpened upper edges of the steel rule die 24; enclosure 14 is positioned over the stacked material layers with the side walls 30 positioned in circumferentially surrounding relation to the material stack 34, with sealing surface 30*c* sealingly engaging closed loop sealing surface 18*g* to define a sealed, vertically collapsible chamber 36, and with disposable pad 29, carried on the underface of top member 28, positioned over layers 34; air is evacuated from the chamber 36 by withdrawing air outwardly through perforations 18*e* in tubular fence inner wall 18*d*, the tubular interior of tubular fence 18, and spout 20 to vertically compress the stack 34 of material and substantially reduce its vertical thickness and to press the compressed reduced thickness layer of material downwardly against the sharpened upper edge of steel rule die 24; and the upper platen 38 of the associated press is lowered in known manner to move the cutting edges of the steel rule die through the compressed reduced thickness layer of material and into pad 29 to cut a fixed pattern in the material corresponding to the composite shape of the steel rule die. The perforations 18*e* in the tubular fence upper wall 18*a* act during the evacuation and cutting process to augment the sealing engagement of sealing surface 30*c* with sealing surface 18*g*. The height of the stack of material prior to evacuation of chamber 36 is seen in FIG. 2 and the compressed height of the stack following evacuation of chamber 36 is seen in FIG. 3. following the cutting operation, upper platen 38 is raised, enclosure 14 is raised, the cut material is removed, a new stack of material to be cut is positioned over the steel rule die assembly, enclosure 14 is positioned over the new stack of material, and the cutting operation is repeated.

Figure 6:
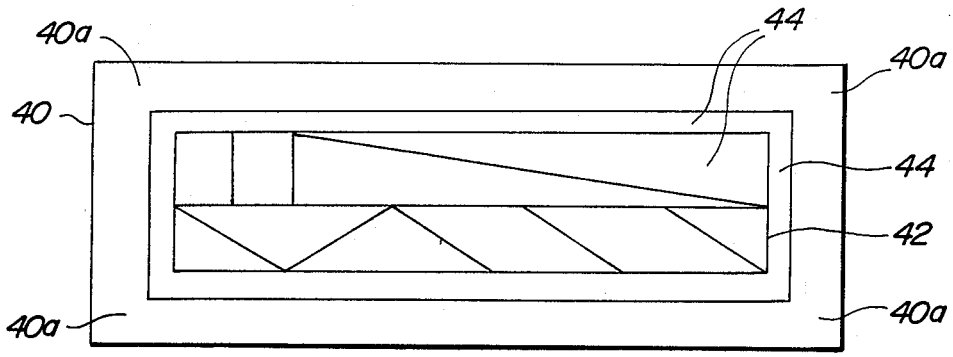
FIG. 6 is a plan view or a steel rule die employed in the apparatus of FIG. 5.
Figure 5:
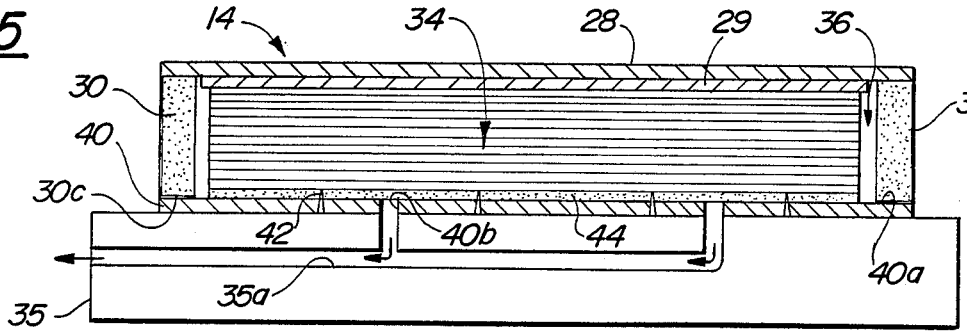
FIG. 5 is a longitudinal cross-sectional view showing a modified form of the invention die cutting apparatus.
Figure 7:
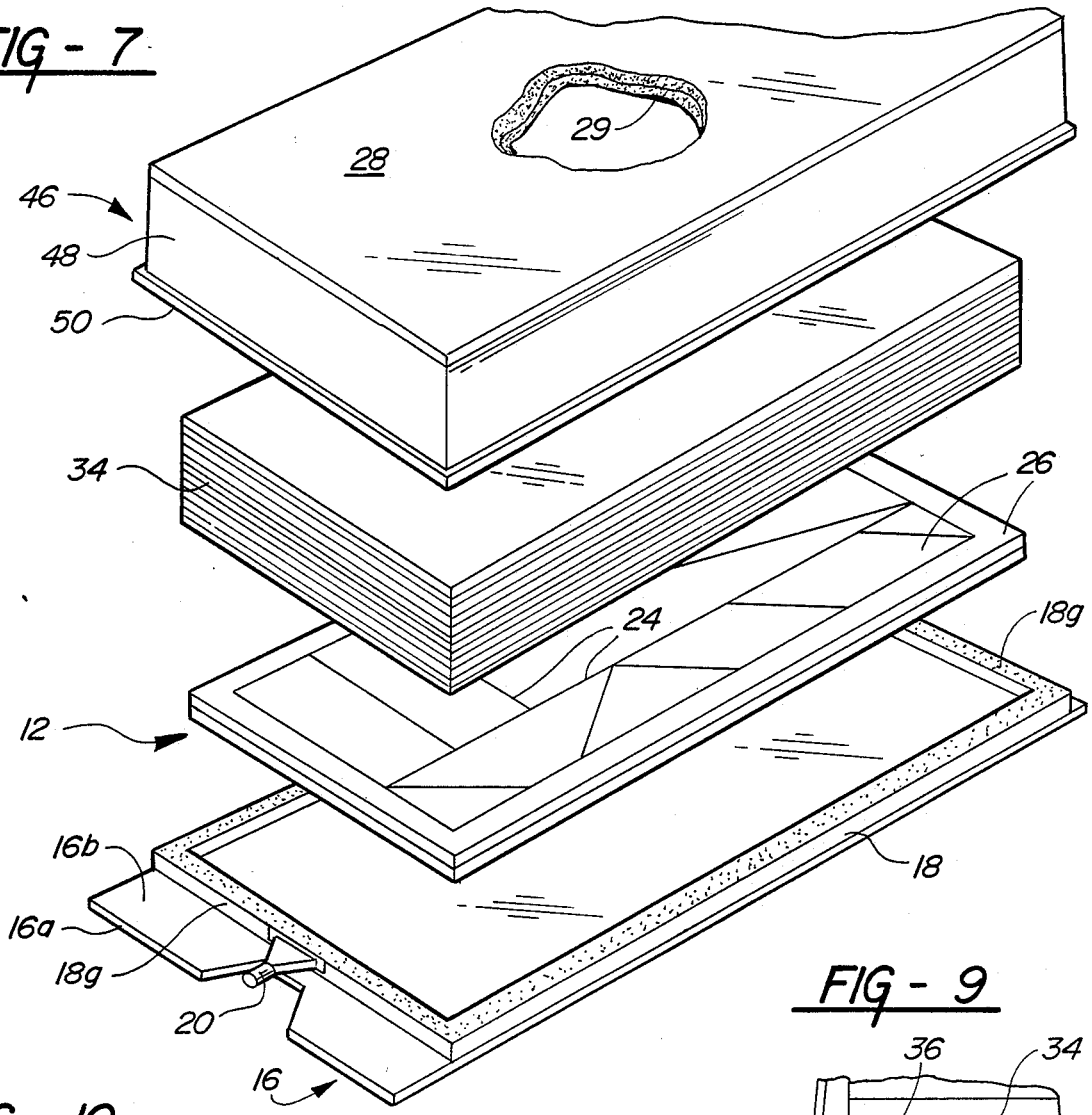
FIG. 7 is an exploded perspective view of a further modified form of the invention die cutting apparatus.
Figure 9:
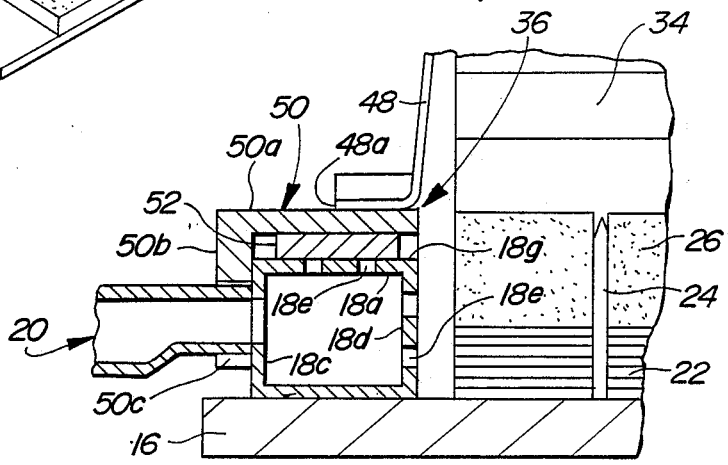
FIGS. 9 and 10 are detailed views taken respectively within the circles 9 and 10 of FIG. 8.
Figure 10:
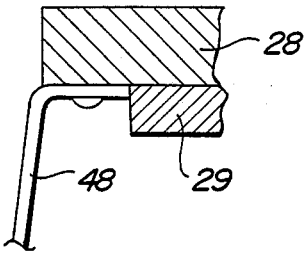
Figure 8:
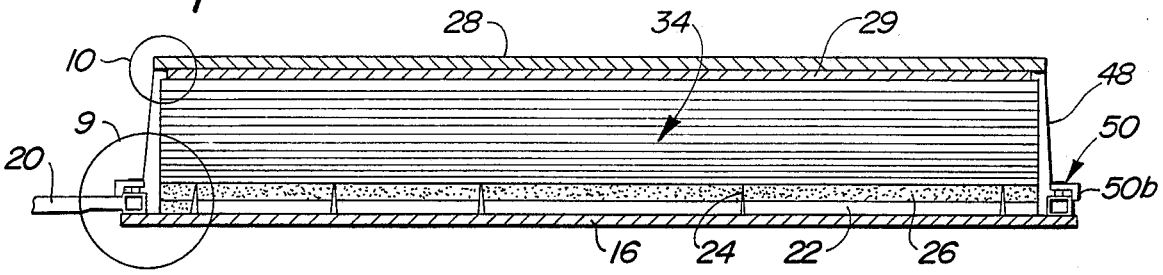
FIG. 8 is a longitudinal cross-sectional view of the die cutting apparatus of FIG. 7 showing the material in its condition prior to compression.

In the modified apparatus seen in FIGS. 5 and 6, the apparatus comprises a support structure in the form of a die board 40, a steel rule die 42 extending upwardly from die board 40 to define the desired cutting pattern, a plurality of open cell plastic foam members 44 positioned in the spaces between the sections of the steel rule die and around the outer peripheral surfaces of the steel rule die, and an enclosure 14 including a top wall 28, a disposable, penetrable pad 29 secured to the underface of top wall member 28, and side walls 30 provided on their outer surfaces and lower edges with an air impervious coating 32. In this embodiment, the lower peripheral edges 30*c* of the side wall members 30 sealingly coact with a closed loop upwardly facing sealing surface 40*a* defined around the upper perimeter of die board 40, and air is withdrawn from the steel chamber 36 through a vacuum passage 35*a* in lower platen 35 communicating with slots 40*b* in die board 40.

In the use of the embodiment of FIGS. 5 and 6, material 34 to be cut is positioned over the steel rule die; enclosure 14 is positioned over the stacked material with the lower peripheral edge 30*c* of the side walls of the enclosure sealingly coacting with the closed loop upwardly facing sealing surface 40*a* defined on die board 40 and pad 29 overlying the stacked layers 34; air is withdrawn from chamber 36 by drawing air downwardly through open cell foam members 44, through slots 40*b* and through passages 35*a* to vertically compress the stack 34 and to press the compressed reduced thickness stack downwardly against steel rule 42; and upper platen 38 is lowered to perform the cutting operation. Following the cutting operation, the enclosure 14 is lifted, the cut pieces are removed, a new stack of layers to be cut is positioned over the steel rule die assembly, and the enclosure is again put in position over the layers of material preparatory to a new cutting operation.

In the modified apparatus seen in FIGS. 7–10, the enclosure 46 comprises a top wall member 28, a disposable pad 29, a curtain 48, and a frame 50.

As with the previous embodiments, top wall member 28 is formed of a suitable rigid plastic material and has a rectangular configuration generally conforming to the configuration of base plate 16, and pad 29 is rectangular, is formed of the same material as top wall member 28, and is suitably removably secured to the underface of top member 28 as by tape or screws.

Curtain 48 is annular and is formed of a flexible impervious sheet material such as rubberized nylon. Curtain 48 is secured along its upper annular edge to the annular underface of top wall member 28 by the use of suitable mechanical fasteners or suitable adhesives and depends downwardly from top wall member 28. Pad 29 is rectangular and fits within curtain 48.

Frame 50 is formed of a suitable metallic material, is substantially rigid, and has an annular configuration with an angular cross section. Specifically, frame 50 includes a horizontal leg portion 50*a* and a vertical leg portion 50*b*. Horizontal leg portion 50*a* conforms in size and shape to the upper closed loop sealing surface 18*g* defined on the upper surface of tubular fence or frame 18. The lower edge of curtain 48 is secured to frame 50 by suitably fastening the lower edge portion 48*a* of the curtain to the upper face of horizontal frame portion 50*a* and an annular layer 52 of resilient material is 20 secured to the underface of horizontal frame portion 50*a*. Layer 52 may, for example, comprise a suitable rubberized material. Vertical leg portion 50*b* of frame 50 fits snugly around tubular frame 18 with the inner face of leg portion 50*b* coacting with the confronting outer face of the outer wall 18*c* of frame 18 to preclude lateral movement of the frame 50 relative to frame 18. A cutout 50*c* in vertical leg 50*b* allows the passage of spout 20.

In the use of the embodiment of FIGS. 7–10, material 34 to be cut is positioned over the steel rule die; enclosure 46 is positioned over the stacked material with the curtain 48 surrounding the stacked material, annular layer 52 sealingly coacting with the closed loop upwardly facing sealing surface 18*g*, and pad 29 positioned over layers 34; air is withdrawn from chamber 36 by drawing air downwardly through the stacked layers 34, through open cell foam members 26, and through tubular member 18 for discharge through spout 20 to vertically compress the stack 34 and press the compressed reduced thickness stack downwardly against steel rule 24; and the upper platen of the press is lowered to perform the cutting operation. Following the cutting operation, enclosure 46 is lifted, the cut pieces are removed, a new stack of layers to be cut is positioned over the steel rule die assembly, and the enclosure is again put in position over the layers of material preparatory to a new cutting operation. As in the previously described embodiments, disposable cutting pad 29 is utilized beneath top member 28 to protect the top member from the cutting action of the steel rule die.

Figure 11:
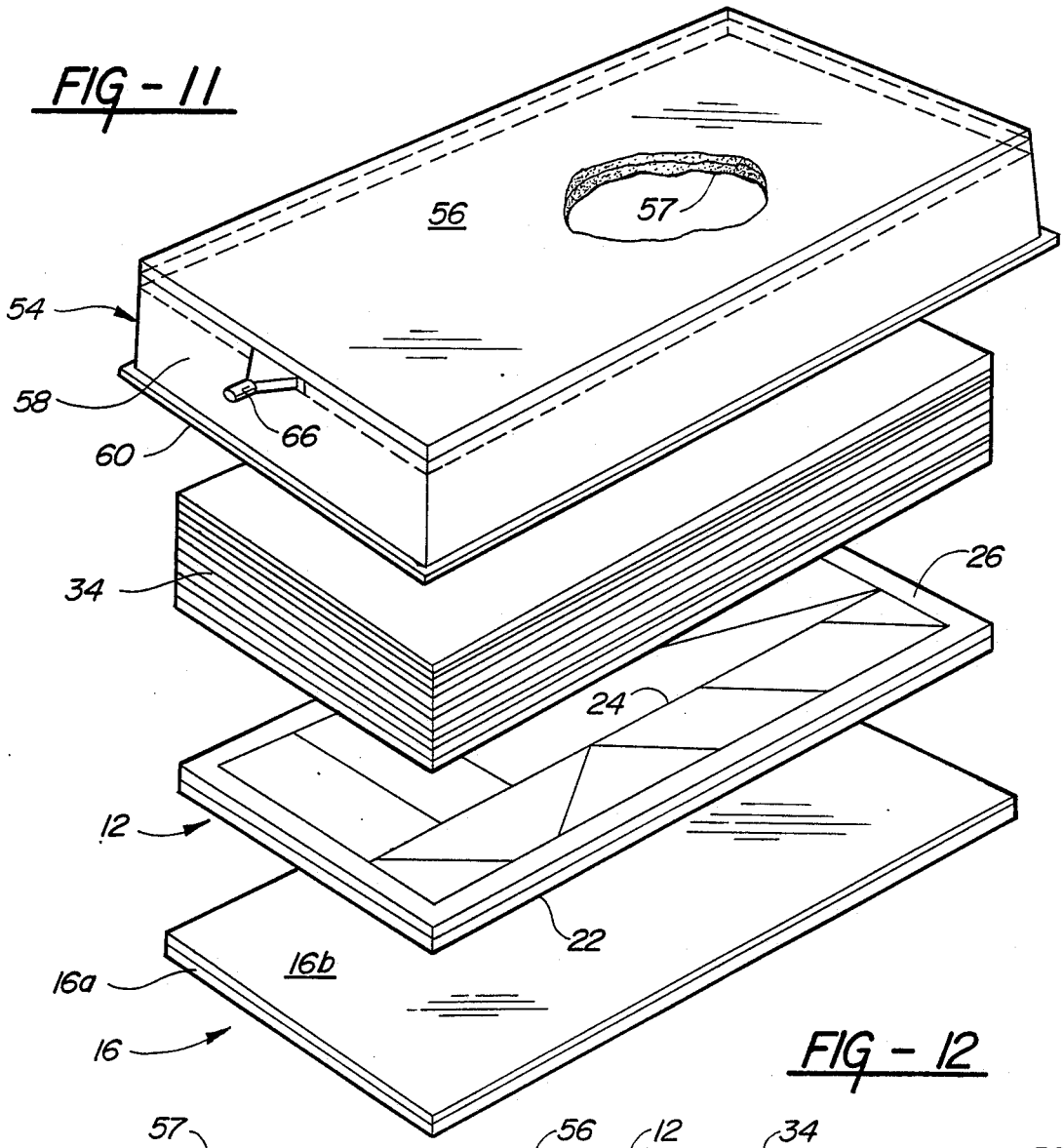
FIG. 11 is an exploded perspective view of a still further modified form of the invention die cutting apparatus.
Figure 12:
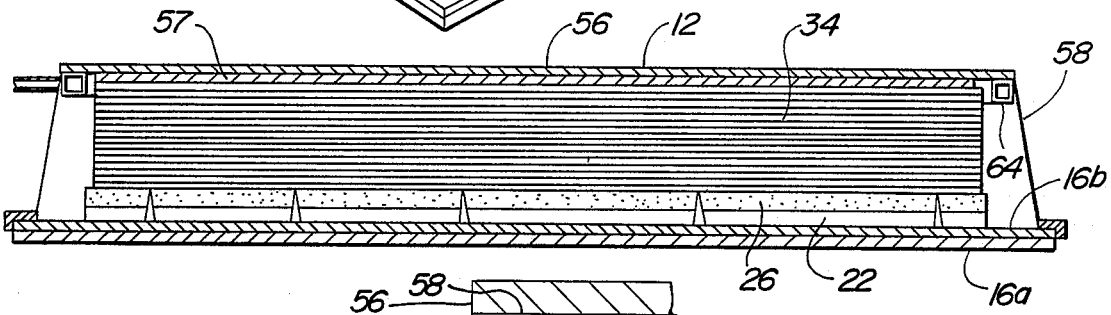
FIG. 12 is a longitudinal cross sectional view of the die cutting apparatus of FIG. 11 showing the material in its condition prior to compression.
Figure 13:
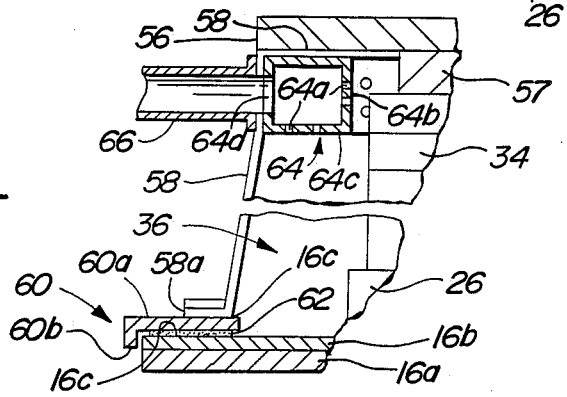
FIG. 13 is a detailed view within the circle 13 of FIG. 12.

In the modified apparatus seen in FIGS. 11–13, the enclosure 54 comprises a top wall member 56, a disposable cutting pad 57, a curtain 58, and a frame 60. Top wall member 56 is formed of a suitable rigid plastic material and has a rectangular configuration generally conforming to the configuration of base plate 16. Pad 57 is suitably removably secured to the underface of top wall member 56 to protect member 56 from the cutting action of the steel roll die.

Curtain 58 is annular and is formed of a flexible impervious sheet material such as rubberized nylon. Curtain 58 is secured along its upper annular edge 58*a* to the annular underface of top wall member 56 in surrounding relation to pad 57 by the use of suitable mechanical fasteners or suitable adhesives and depends downwardly from top wall member 56.

Frame 60 is formed of a suitable metallic material, is substantially rigid, and has an annular, rectangular configuration with an angular cross section. Specifically, frame 60 includes a horizontal leg portion 60*a* and a vertical leg portion 60*b*. Horizontal leg portion 60*a* conforms in size and shape to a closed loop sealing surface 16c defined on the upper surface of upper steel plate 16b of base plate 16 around the steel rule die assembly 12. The lower edge 58a of curtain 58 is suitably secured to the upper face of horizontal frame portion 60a and an annular layer of resilient material 62 is secured to the underface of horizontal frame portion 60a. Layer 62 may for example comprise a suitable rubberized material. Vertical leg portion 60b fits snugly around the periphery of plate 16 to preclude lateral movement of frame 60 relative to plate 16.

The apparatus of FIGS. 11–13 further includes a closed loop tubular frame member 64 which is positioned beneath and around the periphery of top wall 56 within the curtain 58 and in surrounding relation to disposable pad 57. Tubular frame member 64 may be secured to the underperiphery of top wall 56 by the use of adhesives or mechanical fasteners. Tubular frame member 64 is rectangular in transverse cross section and includes circumferentially spaced perforations 64a in its inner and bottom wall portions 64b and 64c. A tubular spout 66 communicates with an opening 64d in the outer wall of tubular member 64 to provide communication between the interior of the spout and the interior of the tubular member.

In the use of the embodiment of FIGS. 11–13, material 34 to be cut is positioned over the steel rule die; enclosure 54 is positioned over the stacked material with the curtain 58 surrounding the stacked material, annular layer 62 sealingly coacting with closed loop upwardly facing sealing surface 16c, and pad 57 positioned over layer 34; air is withdrawn from chamber 36 by drawing air outwardly through perforations 64a, through the hollow interior of tubular member 64, and through spout 66 to vertically compress the stack 34 and press the compressed reduced thickness stack downwardly against steel rule 24; and the upper platen of the press is lowered to perform the cutting operation. Following the cutting operation, enclosure 54 is lifted, the cut pieces are removed, a new stack of layers to be cut is positioned over the steel rule die assembly, and the enclosure is again put in position over the layers of material preparatory to a new cutting operation.

In the modified apparatus seen in FIGS. 14–16, the enclosure 70 comprises a top wall member 72, a disposable cutting pad 73 suitably removably secured to the underface of top member 72, curtain 74, and a tubular frame 76. Top wall member 72 is formed of a suitable rigid plastic material and has a rectangular configuration generally conforming to the configuration of die board 22 of steel rule die assembly 12. Die board 22 has a width and length that exceeds the width and length defined by the foam members 26 surrounding the steel rule 24 so as to define a closed loop upwardly facing sealing surface 22a extending circumferentially around the foam member 26 and the steel rule 24. Base plate 16 is eliminated in the embodiment of FIGS. 14–16 since the sealing surface for coaction with the enclosure is defined on the die board 22.

Curtain 74 is annular and is formed of a flexible impervious sheet material such as rubberized nylon. Curtain 74 is secured along its upper annular edge to the annular underface of top wall member 72 by the use of suitable mechanical fasteners or suitable adhesives and depends downwardly from top wall member 72. Frame 76 is rectangular in transverse cross section and has an overall rectangular configuration sized to seat on sealing surface 22a with its outer walls 76a generally aligned with the respective side edges of die board 22. Frame 76 is secured at its outer walls 76a to the lower edge of curtain 74 by metal flange members 78 which clamp the lower edges of the curtain 74 between the flange members and the outer frame walls 76a, utilizing suitable fasteners. Flange members 78 are sized to extend downwardly below the level of the bottom walls 76b of frame 76 and are intended to fit snugly around the respective side edges of die board 22 to preclude lateral movement as between the enclosure 70 and the die board. An annular layer of resilient material 80 is secured to the underface of lower frame walls 76b. Layer 80 may for example comprise a suitable rubberized material. Perforations 76c are formed in frame lower walls 76b at circumferentially spaced locations therearound and corresponding perforations 80a are formed in layer 80 so as to provide continuous passages extending downwardly through the lower walls of the frame and through the layer 80 to the upper seating face 22a of the die board. Further perforations 76d are provided at circumferentially spaced locations around the inner walls 76e of the frame, and the upper walls 76f of the frame are imperforate.

The apparatus of FIGS. 14–16 further includes a hose 82 formed of a suitable flexible plastic material and having a circular transverse cross section. Hose 82 is secured along its top wall to the underface of top wall 72 in surrounding relation to pad 73 and includes a first portion 82a extending along one end of top wall 72; a further portion 82b extending along one side of top wall 72 to the other end of the top wall; a further portion 82c extending across the end of the top wall 72; a further portion 82d returning along the other side of the top wall 72; and a further portion 2e extending along the first end of the top wall 72 but terminating short of hose portion 82a to leave a lateral space therebetween. Perforations 82f are provided in hose 82 in circumferentially spaced relation along the inner wall portion of the hose, along the bottom wall portion of the hose, and along the outer wall portion of the hose.

In the use of the embodiment of FIGS. 14–16, material 34 to be cut is positioned over the steel rule die; enclosure 70 is positioned over the stacked material with the curtain 74 and hose 82 surrounding the stacked material, with the lower face of resilient layer 80 sealingly coacting with closed loop seating surface 22a, and with pad 73 overlying material stack 34; air is withdrawn from chamber 36 by drawing air laterally outwardly through perforations 76d, through the hollow interior of frame member 76, and through a vacuum spout 66 to vertically compress the stack 34 and press the compressed reduced thickness stack downwardly against steel rule 24; and the platen of the press is lowered to perform the cutting operation. Following the cutting operation, enclosure 70 is lifted, the cut pieces are removed, a new stack of layers to be cut is positioned over the steel rule die assembly, and the enclosure is again put in position over the layers of material preparatory to a new cutting operation.

During the evacuating process, the aligned perforations 76c and 80a serve to suck the frame member 76 downwardly against seat 22a to provide a positive lower seal for chamber 36, and hose 82 acts as a vacuum distribution means to establish the vacuum condition substantially uniformly throughout chamber 36. Specifically, since the air is evacuated from chamber 36 at the end thereof adjacent spout 66, the top wall 72, in the absence of hose 82, would not be pulled down evenly but rather would be pulled down more rapidly adjacent the spout end of the chamber and less rapidly adjacent the other, remote end of the chamber. The perforated hose 82 functions to distribute the vacuum condition substantially uniformly throughout chamber 36 so that top wall 72 is pulled down uniformly and in a translatory manner to compress the stack 34 uniformly throughout the chamber.

In all of the disclosed embodiments, the enclosure may be lifted in and out of position over the stacked layers by a single operator using conventional suction cup lift assist mechanisms and the enclosure may be used over and over again for repeated cutting operations. Alternatively, the enclosure may be lifted in and out of position over the stacked layers by a suitable lift mechanism incorporated as a part of the associated press. In this regard, whereas the various embodiments of the invention have been illustrated and described as if the material layers were placed on the support structure or carrier with the carrier already in position on the lower platen of the press, in many applications it is preferable to provide a preliminary work station adjacent but removed from the press where the layers are placed on the carrier, the enclosure is placed in position over the layers, and the chamber is evacuated to reduce the material thickness, whereafter the assembly is suitably conveyed, either in one movement or in a series of incremental movements, to the area between the upper and lower platens of the press where the cutting operation is performed, either incrementally or in a single cut, by closing movement of the upper and lower platens of the press.

The invention method and apparatus will be seen retains all of the advantages of the method and apparatus disclosed in U.S. Pat. No. 4,543,862 but additionally significantly reduces the labor and material costs as compared to the method and apparatus of that patent.

Whereas preferred embodiments of the invention have been illustrated and described in detail, it will be apparent that various changes may be made in the disclosed embodiments without departing from the scope or spirit of the invention.

We claim:

1. A method of cutting compressible materials comprising:

(a) providing a generally planar support structure;

(b) providing an upwardly facing cutting edge on said support structure;

(c) positioning a layer of compressible material over said cutting edge;

(d) forming an enclosure over said layer of material and over said cutting edge including a top wall overlying said layer of material, collapsible side walls extending downwardly from said top wall, and a rigid annular structure secured to the lower edge of said side walls and adapted to seal on said support surface in circumferentially surrounding relation to said cutting edge and said layer of material;

(e) evacuating air from said chamber through said rigid annular structure to vertically collapse said side walls to an extent to vertically compress said layer of material and substantially reduce its vertical thickness and to press said compressed reduced thickness layer of material downwardly against said edge; and (f) moving said cutting edge through said compressed reduced thickness layer of material to cut a fixed pattern in the material corresponding to the shape of the cutting edge.

2. A method according to claim 1 wherein:

(g) a closed loop peripherl upwardlying facing sealing area is defined on said support structure around said cutting edge; and (h) said sealed chamber is formed by positioning said enclosure over said layer of material with the lower periphery of said rigid annular member sealingly engaging said closed loop sealing surface on said support structure.

3. A method according to claim 2 wherein:

(i) said enclosure side walls comprise an annular curtain of flexible air impervious sheet material which collapses in response to evacuation of said chamber.

4. A method according to claim 3 wherein:

(j) said flexible air impervious sheet material comprises a rubberized material.

5. A method according to claim 2 wherein:

(i) said rigid annular structure comprises a tubular frame secured to the lower edge of said side walls and sealingly engaging said closed loop sealing surface.

6. A method according to claim 5 wherein:

(j) an annular layer of resilient material is secured to the annular underface of said tubular frame to facilitate the sealing engagement of said frame with said closed loop sealing surface.

7. A method according to claim 5 wherein:

(j) said tubular frame includes perforations in a peripheral wall thereof; and (k) said evacuating step includes evacuating air laterally outwardly from said chamber through said perforations.

8. A method according to claim 7 wherein:

(l) said tubular frame has a generally flat lower wall for sealing on said surface and perforations are provided in said lower wall.

9. A method according to claim 8 wherein:

(m) an annular layer of resilient material is secured to the annular underface of said flat lower wall of said tubular frame; and (n) said layer of resilient material has perforations therein generally corresponding to the perforations in said lower wall of said tubular frame.

10. A method according to claim 7 wherein:

(l) said tubular frame includes an annular flange portion extending downwardly therefrom and sized to snugly engage the outer periphery of said support structure.

11. A method according to claim 1 wherein:

(g) said air is evacuated from said chamber through said rigid annular structure adjacent one end of said chamber; and (h) said method includes the further step of providing vacuum distribution means within said enclosure operative to establish the vacuum condition substantially uniformly throughout said chamber.

12. A method according to claim 11 wherein:

(i) said vacuum distribution means comprises a perforated tubular member positioned within said chamber proximate the underside of said top wall and extending from said one end of said chamber to an opposite end thereof.

13. A method according to claim 12 wherein:

(j) said top wall and said rigid annular structure are substantially rectangular so as to define a substantially rectangular chamber; and (k) said tubular member extends from said one end of said chamber, along one side of said chamber, across said opposite end of said chamber, and back along the other side of said chamber to said one end of said chamber.

14. An apparatus for cutting compressible materials comprising:

(a) a generally planar support structure;

(b) a cutting edge extending upwardly from said support structure and adapted to have the compressible material to be cut positioned thereon;

(c) enclosure means including a top wall overlying the compressible material to be cut, collapsible side walls extending downwardly from said top wall, and a rigid annular structure secured to the lower edge of said side walls and adapted to seat on said support structure in circumferentially surrounding relation to said cutting edge and to the material to be cut and coacting with said support structure, said collapsible side walls, and said top wall to form a sealed vertically collapsible chamber totally enclosing said cutting edge and the material to be cut; and (d) means for evacuating air from said chamber through said rigid annular structure to collapse said side walls and collapse said chamber to an extent to vertically compress the material and press the compressed material downwardly against said cutting edge.

15. An apparatus according to claim 14 wherein:

(e) said support structure defines a closed loop upwardly facing sealing surface in circumferentially surrounding relation to said cutting edge; and (f) said rigid annular structure seats on said closed loop sealing surface to define said sealed chamber.

16. An apparatus according to claim 15 wherein:

(f) said enclosure side walls comprise an annular curtain of air impervious flexible sheet material which collapses in response to evacuation of said chamber.

17. An apparatus according to claim 16 wherein:

(g) said flexible sheet material comprises rubberized nylon material.

18. An apparatus according to claim 16 wherein:

(g) said rigid annular structure comprises a tubular frame secured to the lower edge of said curtain and sealingly engaging said closed loop sealing surface.

19. An apparatus according to claim 18 wherein:

(h) an annular layer of resilient material is secured to the annular underface of said rigid frame to facilitate the sealing engagement of said frame with said closed loop sealing surface.

20. An apparatus according to claim 18 wherein:

(h) said tubular frame is perforated within said curtain; and (i) said evacuating means comprises means for drawing air out of said tubular frame and thereby out of said chamber.

21. An apparatus according to claim 20 wherein:

(j) said tubular frame has a generally flat lower wall for sealing on said sealing surface; and (k) perforations are provided in said lower wall.

22. An apparatus according to claim 21:

(l) an annular layer of resilient material is secured to the annular underface of said flat lower wall of said tubular frame; and (m) said layer of resilient material has perforations therein generally corresponding to the perforations in said lower wall of said tubular frame.

23. Apparatus according to claim 20 wherein:

(j) said tubular frame includes an annular flange structure extending downwardly therefrom and sized to snugly surround the periphery of said support structure.

24. An apparatus according to claim 14 wherein said apparatus further includes:

(f) means for drawing air out of said frame adjacent one end thereof; and (g) vacuum distribution means within said enclosure operative to establish the vacuum condition substantially uniformly throughout said chamber.

25. An apparatus according to claim 24 wherein:

(h) said vacuum distribution means comprises a perforated tubular member positioned within said chamber proximate the underside of said top wall and extending from said one end of said chamber to an opposite end thereof.

26. An apparatus according to claim 25 wherein:

(i) said top wall and said rigid annular structure are substantially rectangular so as to define a substantially rectangular chamber; and (k) said tubular member extends from said one end of said chamber, along one side of said chamber, across said opposite end of said chamber, and back along the other side of said chamber to said one end of said chamber.

* * * * *

UNITED STATES PATENT AND TRADEMARK OFFICE

CERTIFICATE OF CORRECTION

PATENT NO. : 4,960,019
DATED : October 2, 1990
INVENTOR(S) : Martin M. Levene and William W. Lessard It is certified that error appears in the above-identified patent and that said Letters Patent is hereby corrected as shown below:

Title page,
Item [*], Notice "The portion of the term of this patent subsequent to Aug. 1, 2006 has been disclaimed." has been replaced by -- This patent is subject to a terminal disclaimer. --

Signed and Sealed this

Nineteenth Day of August, 2003

JAMES E. ROGAN
*Director of the United States Patent and Trademark Office*